US006991195B2

(12) United States Patent
Mazzarolo

(10) Patent No.: US 6,991,195 B2
(45) Date of Patent: Jan. 31, 2006

(54) WRAPPING APPARATUS

(76) Inventor: Artemio Mazzarolo, 560 Finley Avenue, Ajax, Ontario (CA) L1S 2E3

( * ) Notice: Subject to any disclaimer, the term of this patent is extended or adjusted under 35 U.S.C. 154(b) by 17 days.

(21) Appl. No.: 10/659,426

(22) Filed: Sep. 11, 2003

(65) Prior Publication Data

US 2004/0046083 A1 Mar. 11, 2004

(30) Foreign Application Priority Data

Sep. 11, 2002 (CA) ..... 2402670

(51) Int. Cl.
*B65H 16/02* (2006.01)

(52) U.S. Cl. ..... 242/557; 53/390; 53/556; 53/588

(58) Field of Classification Search ..... 242/559.4, 242/557, 597.7, 588, 588.2; 53/390, 556, 53/588

See application file for complete search history.

(56) References Cited

U.S. PATENT DOCUMENTS

| | | | | |
|---|---|---|---|---|
| 4,369,614 | A * | 1/1983 | Tetzner | 53/556 |
| 4,409,776 | A * | 10/1983 | Usui | 53/556 |
| 5,562,385 | A * | 10/1996 | Tacchi et al. | 242/559.4 |
| 6,041,676 | A * | 3/2000 | Bettenhausen | 53/556 |
| 6,470,657 | B2 * | 10/2002 | Huson et al. | 53/588 |
| 6,526,734 | B1 * | 3/2003 | Huson et al. | 53/588 |

* cited by examiner

*Primary Examiner*—William A. Rivera
(74) *Attorney, Agent, or Firm*—Birch, Stewart, Kolasch & Birch, LLP

(57) ABSTRACT

The apparatus has a base mounted on castors and upon which a telescopic post is mounted. A winch is mounted on the top of the post. A roll of flexible material is mounted on a bed and is rotatable about the post, The winch raises and lowers the bed so that the height of the roll may be adjusted to that most convenient for wrapping. By means of the castors, the apparatus may be moved around the article as it is being wrapped. The apparatus is suitable for stretch-wrapping an article which is irregular in shape or is heavy and is unusually difficult to wrap.

4 Claims, 2 Drawing Sheets

WRAPPING APPARATUS

FIELD OF THE INVENTION

This invention relates to wrapping apparatus and more particularly to a apparatus for stretch-wrapping an article with flexible material from a roll of such material. The apparatus supports the roll at a height which may be adjusted to that most convenient for wrapping and is movable so that the roll may be moved around the article as it is being wrapped

BACKGROUND OF THE INVENTION

It is common for newly manufactured articles to be wrapped with polyethylene or other polymeric material to protect its outer surface from scratches, from contact with corrosive fluids and the like. Articles which are irregular in shape or are heavy are unusually difficult to wrap. Heavy machinery for example is commonly attached to a skid after it is manufactured and both the machinery and the skid are wrapped before being shipped from the factory where it was manufactured. In most cases, such machinery is wrapped by an operator who holds a sheet of wrapping material and walks around the machinery again and again while raising and lowering the sheet and while maintaining the material under tension until the apparatus is completely enveloped. Wrapping by this means is physically taxing because the sheet of wrapping material is heavy and because the sheet must be constantly pulled to keep it under tension.

I have invented an apparatus by means of which an article may be wrapped in an improved way over the conventional way. The apparatus supports a roll of wrapping material at a height that can be adjusted. Furthermore, the apparatus is mounted on wheels, castors and the like so that it can be moved around the article or it can be located where it will best facilitate the wrapping operation. An operator does not have to carry the roll by hand, to raise and lower it by hand or to pull it to keep the wrapping material under tension. As a result the operator avoids back strain, fatigue and injuries resulting from fatigue when he is using the apparatus.

SUMMARY OF THE INVENTION

Briefly the wrapping apparatus of my invention comprises: a base mounted for rolling; a post extending upwardly from the base; a winch mounted to the post; and supporting means for a roll of wrapping material. The supporting means is operatively connected to the winch and is raised and lowered thereby.

DESCRIPTION OF THE DRAWINGS

The wrapping apparatus of my invention is described with reference to the accompanying drawings in which.

Like reference characters refer to like parts throughout the description of the drawings.

DESCRIPTION OF PREFERRED EMBODIMENT

Figure 1:
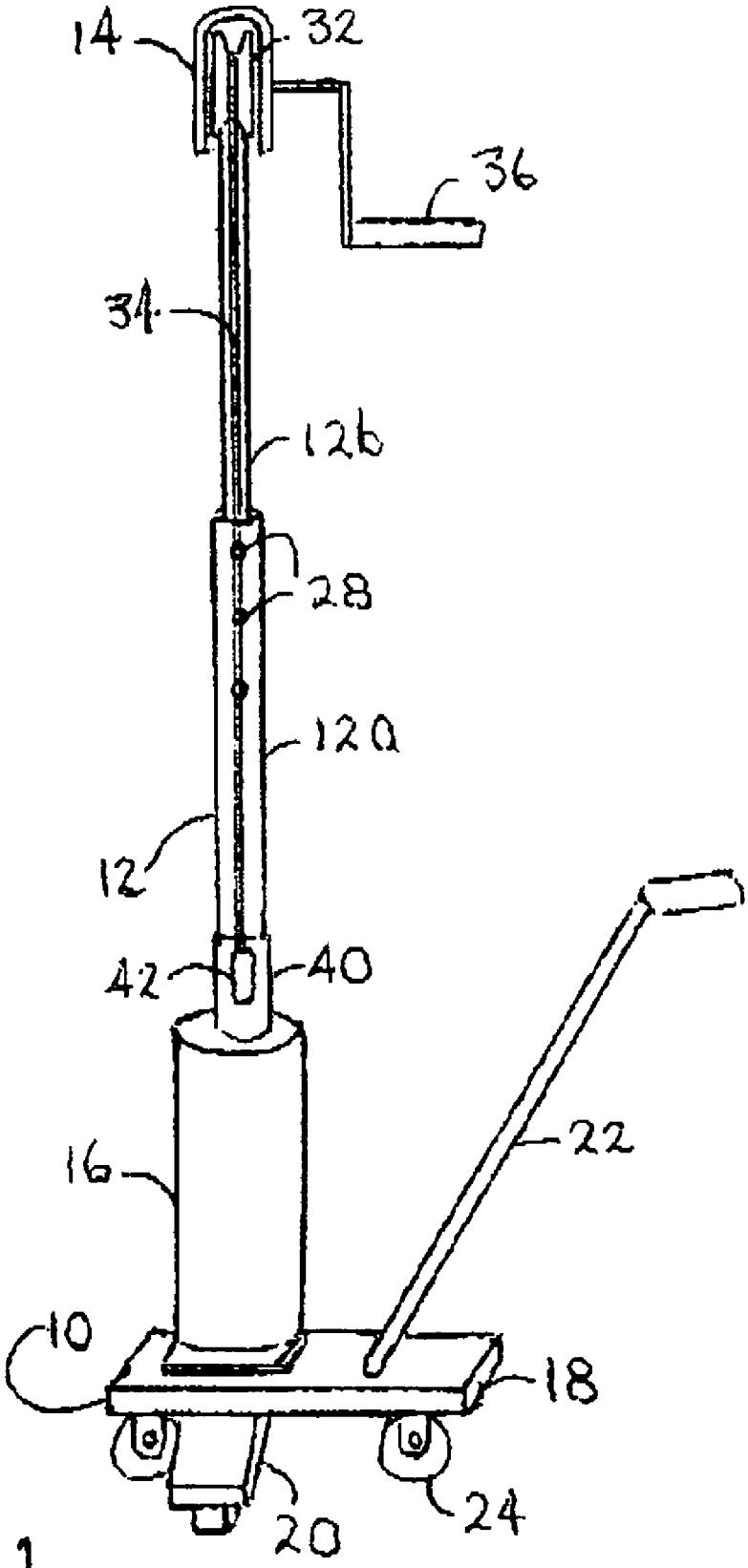
FIG. 1 is an elevation of the wrapping apparatus from the side in conjunction with a roll of flexible wrapping material.

With reference to FIG. 1, the wrapping apparatus includes a base 10, a post 12 which is connected to the base and extends upwardly therefrom and a winch 14 mounted to the top of the post. A roll 16 of flexible wrapping material extends around and surrounds the post.

The base is composed of a pair of cross bars 18, 20. Bar 18 is longitudinally extending and a handle 22 extends upwardly from one of its ends. Bar 20 is laterally extending beneath bar 18.

A castor 24 is attached to the two ends of each bar so that the base may be rolled across a floor. Handle 22 facilitates such rolling and also the steering of the base while it is so rolling.

The post is composed to two segments, a lower segment 12*a* and an upper segment 12*b*. The upper segment fits into an opening in the lower segment and each segment is provided with a series of openings 28 spaced along their lengths for receipt of a pin for holding the two segments together. The post is thus extendible or telescopic.

The winch is mounted to the top of the upper segment and has a conventional pulley 32 around which a cable 34 is wound. The pulley is turned by means of a handle 36.

Figure 2:
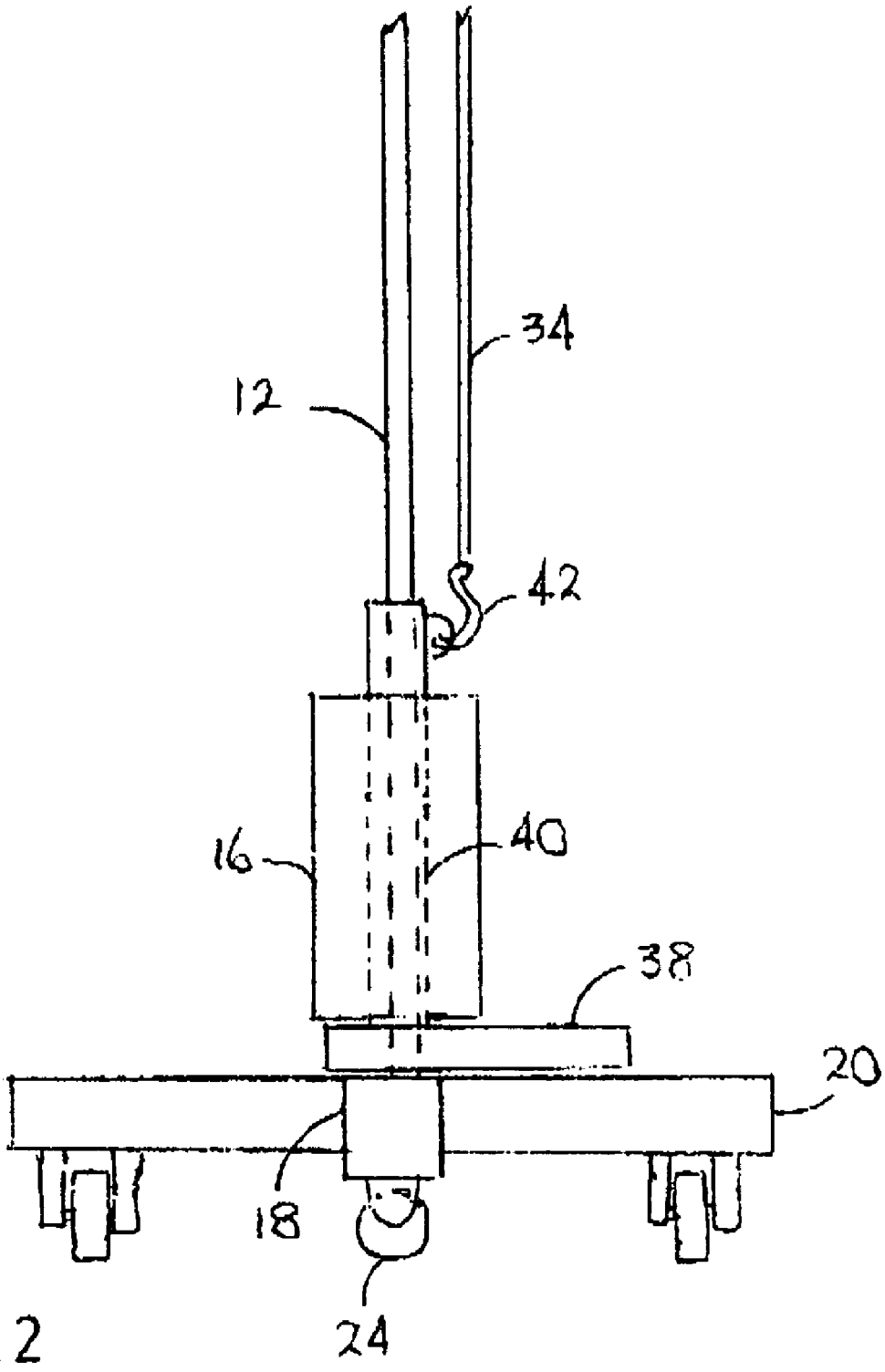
FIG. 2 is an elevation from the end of the apparatus showing the supporting means for the roll of wrapping material.

With reference to FIG. 2, the supporting means for a roll of wrapping material includes a bed 38 and a tube 40 which extends upwardly from the bed. The cable of the winch is attached to the tube by means of hook 42.

Tube 40 surrounds post 12 and the tube in turn is surrounded by roll 16 of wrapping material as illustrated in the drawings. The roll is seated on the bed and is raised and lowered by means of the winch.

In operation, the wrapping apparatus is moved until it close to the object which is to be wrapped. By means of the winch, the roll of wrapping material is then raised or lowered until it is adjacent to the article. The material is then unwound from the roll and attached to the object by such means as adhesive tape. The wrapping apparatus is then moved around the article while the wrapping material unwinds until the article is completely enveloped by the material.

The wrapping apparatus of the invention is suitable for wrapping a variety of different articles such as those in boxes and those which, because of their irregular shapes, are difficult to wrap by hand. The apparatus is particularly suitable for wrapping articles on skids.

It will be understood, of course, that modifications can be made to the wrapping apparatus illustrated and described herein without departing from the scope of the invention.

I claim:

1. An apparatus for wrapping an article for flexible material comprising:

a base mounted for rolling;

a post extending upwardly from said base;

a winch mounted to said post;

and supporting means for a roll of flexible material, said supporting means being operatively connected to said winch and being raised and lowered thereby, said supporting means including a bed and a tube which extends upwardly from said bed and which is disposed around and surrounds said post, said roll of flexible material being adapted to be seated upon said bed and to surround and to revolve around both said tube and said post.

2. The apparatus as claimed in claim 1 further including a handle connected to said base for facilitating the movement of said base.

3. The apparatus as claimed in claim 1 wherein said post is extendible such that the level of said winch can be adjusted.

4. The apparatus as claimed in claim 1 wherein said winch includes a cable which is connected to said post, and which is connected to said supporting means, said winch being operable to raise and lower said supporting means by causing said cable to alternatively extend and retract with resulting lowering and raising of said supporting means, respectively, said winch being disposed on top of said post.

* * * * *